US005311845A

United States Patent [19]

Takahashi

[11] Patent Number: 5,311,845

[45] Date of Patent: May 17, 1994

[54] OIL PRESSURE LASH ADJUSTER EQUIPPED WITH AIR VENT

[75] Inventor: Shigetada Takahashi, Tokyo, Japan

[73] Assignee: Nittan Valve Co., Ltd., Tokyo, Japan

[21] Appl. No.: 30,492

[22] PCT Filed: Oct. 11, 1991

[86] PCT No.: PCT/JP91/01389

§ 371 Date: Mar. 25, 1993

§ 102(e) Date: Mar. 25, 1993

[87] PCT Pub. No.: WO92/07171

PCT Pub. Date: Apr. 30, 1992

[30] Foreign Application Priority Data

Oct. 12, 1990 [JP] Japan ..... 2-106532

[51] Int. Cl.[5] ..... F01L 1/24

[52] U.S. Cl. ..... 123/90.43; 123/90.46

[58] Field of Search ..... 123/90.39, 90.41, 90.43, 123/90.45, 90.46, 90.55

[56] References Cited

U.S. PATENT DOCUMENTS

| | | | |
|---|---|---|---|
| 3,913,538 | 10/1975 | Ableitner et al. | 123/90.46 |
| 4,762,096 | 8/1988 | Kamm et al. | 123/90.43 |
| 4,913,106 | 4/1990 | Rhoads | 123/90.55 |
| 4,917,059 | 4/1990 | Umeda | 123/90.43 |
| 4,941,438 | 7/1990 | Muto | 123/90.43 |

FOREIGN PATENT DOCUMENTS

| | | | |
|---|---|---|---|
| 58-136606 | 9/1983 | Japan . | |
| 60-206915 | 10/1985 | Japan . | |
| 60-185004 | 12/1985 | Japan . | |
| 61-186712 | 11/1986 | Japan . | |
| 301906 | 12/1989 | Japan | 123/90.46 |

*Primary Examiner*—Raymond A. Nelli
*Assistant Examiner*—Weilun Lo
*Attorney, Agent, or Firm*—Michael J. Striker

[57] ABSTRACT

An internal combustion engine with oil pressure rush adjustable valve actuating mechanism has a cylinder head having a lash adjuster mounting hole with an upper opening, an oil gallery formed on an inner circumference of the lash adjuster mounting hole for supplying an actuating oil, an oil pressure lash adjuster having a lash adjuster main body inserted in the lash adjuster mounting hole and a plunger located in the lash adjuster main body and lockable by the actuating oil supplied from the oil gallery, a valve actuating member having a swingable rocker arm arranged so that the lash adjuster main body forms a supporting point for swinging of the rocker arm and an air vent communicating a lower end portion of the lash adjuster mounting hole with the oil gallery.

7 Claims, 4 Drawing Sheets

OIL PRESSURE LASH ADJUSTER EQUIPPED WITH AIR VENT

BACKGROUND OF THE INVENTION

The present invention relates to an oil pressure rush adjuster to be used for a valve actuating mechanism in an internal combustion engine, in which a space or a clearance formed at the valve is automatically rectified or corrected, particularly to an oil pressure lash adjuster equipped with an air vent which is capable of smoothly mounting the main body (or main assembly) of the lash adjuster to a rush adjuster mounting hole.

A valve actuating mechanism to be used in an internal combustion engine is generally liable to be subjected to the influence of wear or thermal expansion, so that a space or clearance formed at the valve used in the mechanism may be changed during the operation thereof. Accordingly, an oil pressure lash adjuster has been used so as to rectify or correct the above space or clearance.

As shown in FIG. 7, a conventional oil pressure rush adjuster has a structure such that a main body 2 of the lash adjuster (hereinafter referred to as "adjuster main body") is mounted to a mounting hole 30 formed in a cylinder head 10. The adjuster main body 2 comprises a body 24 and a plunger 26 which is arranged in the body 24 so that it is slidable in the upward and downward directions. In the plunger 26, there is formed a reservoir 28 which communicates with an oil gallery 32 which opens in the mounting hole 30 through small holes **24*b* and 27*a*. The reservoir 28 communicates with a high pressure chamber 29 through a small hole 27*b*. The reservoir 28 and the high pressure chamber 29 are filled with an actuating oil which is supplied from the oil gallery 32. In FIG. 7, the reference numerals 14, 16 and 17 denote a valve member, a cam and a rocker arm, respectively, which are members constituting the valve actuating mechanism. When a pressure is applied to the actuating oil, a check ball 25*a* disposed in the high pressure chamber 29 blocks the small hole 27*b* and the plunger 26 in a locked state constitutes a swinging supporting point for the rocker arm 17. In addition, when a nose 16*a* of the cam presses to rocker arm 17, the locker arm 17 is swung so that the valve member 14 is slid against a restoring spring 15 to be opened. Thereafter, when the cam 16 is rotated, the valve member 14 is closed under the action of the restoring spring 15. The reference numeral 23 denotes a plunger spring. The plunger 26 is always kept in a state such that it is caused to contact the rocker arm 17 under the action of the plunger spring 23. The plunger 26 is operated so that it corrects the space or clearance formed in the valve actuating mechanism due to the thermal deformation thereof, and the occurrence the space or clearance is prevented. In addition, in the cylinder head 10, there is formed an air vent 4 which extends from the mounting hole 30 to the ambient air, and the air vent 4 may function as an air vent when the adjuster main body 2 is inserted into the mounting hole 30. More specifically, when the adjuster main body 2 is intended to be mounted to the mounting hole 30, the adjuster main body 2 which has been disposed above the mounting hole 30 is inserted into the mounting hole 30. At this time, the air contained in the mounting hole 30 is discharged through the air vent 4 so that the insertion of the adjuster main body 2 is not prevented. As a result, it is possible to insert the adjuster main body 2 into the mounting hole 30. However, in the conventional oil pressure lash adjuster as described above, there is provided the air vent 4 which extends from the inside of the mounting hole 30 to the ambient air. Accordingly, when the internal combustion engine is stopped, the actuating oil filling the reservoir 28 and the oil gallery 32 is passed through the clearance between the body 24 and the mounting hole 30 and leaks out through the air vent 4 toward the outside of the mounting hole 30. Accordingly, the oil level is lowered to a position denoted by H in FIG. 7. In such a case, when the engine is restarted, etc., and the actuating oil is drawn from the reservoir 28, the air disposed above the oil level can simultaneously be drawn into the high pressure chamber 29 together with the actuating oil. Particularly, when the internal combustion engine is stopped while the cam nose 16*a* is caused to contact the rocker arm 17, the plunger 26 is compressed and is in a most shortened state (or bottomed condition). If the engine is restarted under the above condition, the sliding stroke between the plunger 26 and the body 24 becomes maximum, and the amount of the actuating oil drawn into the high pressure chamber 29 also becomes maximum. However, since the actuating oil is not supplied from the internal combustion engine side while the engine is stopped, it is almost impossible to ensure the proper amount of the oil contained in the reservoir 28. As a result, in such a case, the air is drawn into the high pressure chamber 29 most drastically, when the engine is restarted. When the air is drawn into the high pressure chamber 29, the rigidity of the actuating oil which is to be generated in the high pressure chamber 29 when the plunger 26 is pressed, is extremely reduced so that a sponge condition is provided. As a result, the space or clearance of the valve cannot be rectified. In addition, when an internal combustion engine is driven while the actuating oil is supplied to the reservoir 28, the actuating oil leaks out through the air vent 4** through the same passage through which the actuating oil leaks out at the time of the stoppage of the internal combustion engine as described above, whereby the actuating oil is wastefully consumed. When the actuating oil is wastefully consumed, it is possible that the oil is not sufficiently supplied to the parts such as the metal constituting the crank shaft and the cam shaft, etc., to which the oil is to be supplied, and the seizure (or seizing) thereof occurs. Further, there can also be posed a problem such that a pump having a large capacity is required in view of the amount of the oil which can leak out.

SUMMARY OF THE INVENTION

An object of the present invention is, in view of the above problems posed in the prior art, to provide an oil pressure lash adjuster equipped with an air vent, which is capable of maintaining a state wherein the interior of the main body of the lash adjuster (or the interior of the reservoir thereof) is filled with an actuating oil, not only at the time of the driving of an internal combustion engine, but also at the time of the stoppage thereof.

According to the present invention which has attained the above object, there is provided an oil pressure lash adjuster equipped with an air vent and comprising a lash adjuster mounting hole formed in a cylinder head and having an upper opening, an oil gallery formed on an inner circumference of the lash adjuster mounting hole for supplying an actuating oil, and a lash adjuster main body which is to be inserted into the lash adjuster mounting hole so that a plunger contained therein is locked by the actuating oil supplied from the oil gallery and the lash adjuster main body constitutes a supporting point for the swinging of a locker arm as a valve actuating member wherein in accordance with the present invention, the lower end portion of the lash adjuster mounting hole communicates with the oil gallery through the air vent.

In the above oil pressure lash adjuster, a recess groove in the form of a strip which functions as a passage for the actuating oil for locking the plunger contained in the adjuster main body, may be formed at a position of the adjuster main body corresponding to the oil gallery so that it surrounds the adjuster main body. The air vent may be constituted by a groove formed in at least one side of the outer circumference of the adjuster main body disposed below the recess groove in the form of a stripe, and the inner circumference of the lash adjuster mounting hole disposed in sliding contact with the outer circumference of the adjuster main body.

Further, in the above oil pressure lash adjuster, a tapered portion may be formed in the lower end portion of the adjuster main body so that the diameter of the tapered portion decreases toward the lower end of the adjuster main body, and a chamber in the form of a circle or ring formed by the tapered portion and the lash adjuster mounting hole may communicate with the air vent.

Further, in the above oil pressure lash adjuster, the groove in the adjuster main body side for constituting the air vent may comprise a helical groove or a longitudinal groove, and the groove in the lash adjuster mounting hole side for constituting the air vent may comprise a helical groove or a longitudinal groove.

According to the present invention as describe above, the lower end portion of the lash adjuster mounting hole communicates with the oil gallery by the medium of the air vent, so that the actuating oil filling the interior of the adjuster main body (or the interior of the reservoir) does not overflow or leak not only at the time of the driving of the internal combustion engine but also at the time of the stoppage thereof. As a result, the interior of the adjuster main body (or the interior of the reservoir) is always maintained in a state wherein the interior as described above is filled with the actuating oil.

In addition, when the lash adjuster main body is inserted into the mounting hole, the air or the actuating oil disposed in the mounting hole is pressed by the rush adjuster main body so that it is discharged to the oil gallery through the medium of the air vent. As a result, the lash adjuster main body can smoothly be inserted into the mounting hole.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 5(*b*) is a sectional view taken along a line V—V shown in FIG. 5(*a*).

DESCRIPTION OF PREFERRED EMBODIMENTS

Figure 1:
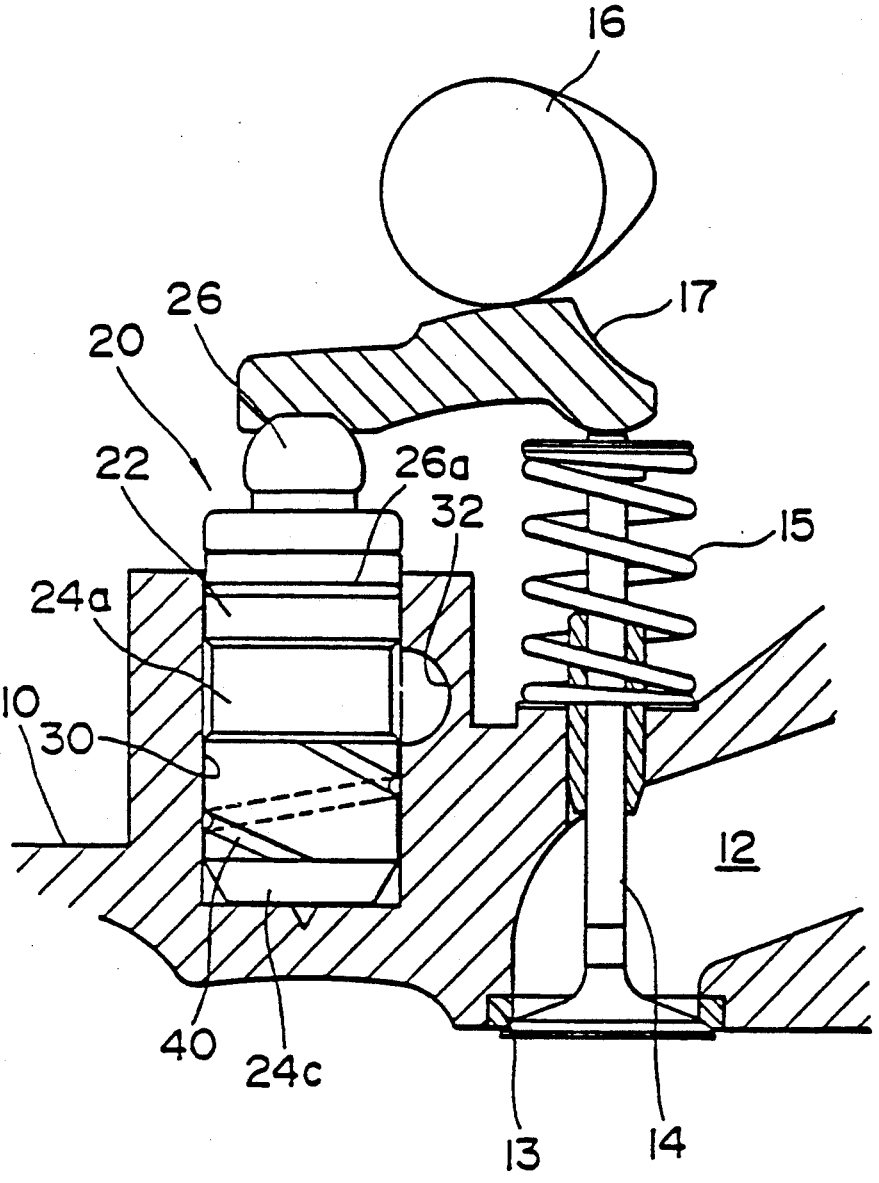
FIG. 1 is a sectional view showing a valve actuating mechanism to be used for an OHC type internal combustion engine according to a first embodiment of the present invention.
Figure 2:
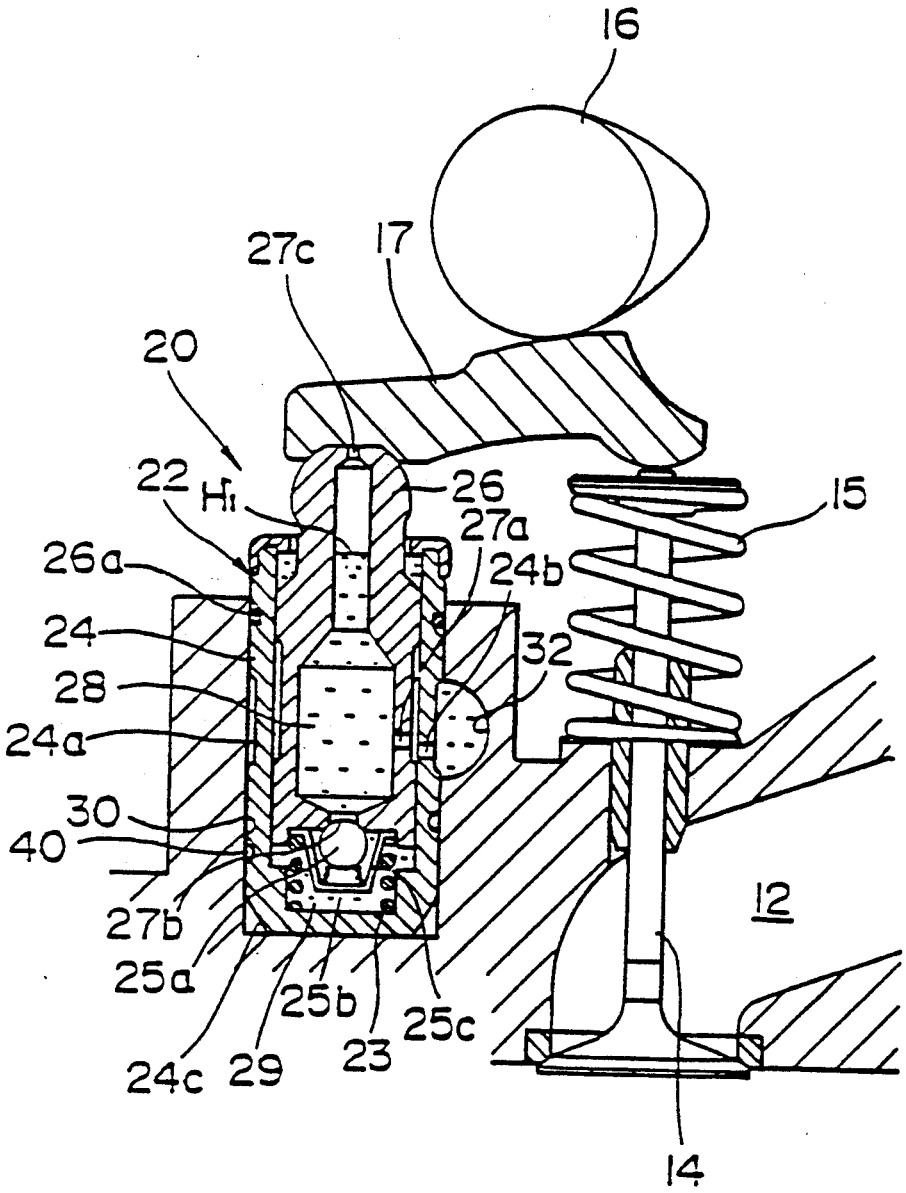
FIG. 2 is a sectional view showing the above valve actuating mechanism wherein a cross section of a lash adjuster is shown.

FIGS. 1 and 2 show an embodiment wherein the present invention is applied to a valve actuating mechanism for an overhead cam shaft (OHC) type internal combustion engine. Periphery of an oil pressure lash adjuster equipped with an air vent. FIG. 2 is a sectional view showing the periphery of the oil pressure lash adjuster wherein a cross section of the oil pressure lash adjuster is shown.

In the FIGS., a reference numeral 10 denotes a cylinder head. In an air inlet passage 12 formed in the cylinder head 10, there is disposed a valve member 14 inserted therein. The valve member 14 is urged toward a direction in which the air inlet passage 12 is closed under the action of a valve member restoring spring 15. The upper end portion of the valve member 14 is caused to contact a rocker arm 17 which is swingable on the basis of the rotation of a cam 16.

A reference numeral 20 denotes a lash adjuster disposed adjacent to a valve member 10. The lash adjuster 20 has a structure such that an adjuster main body 22 is inserted into an adjuster mounting hole 30 having an upper opening. The adjuster main body 22 mainly comprises a body 24 having a cylindrical shape and having an upper opening, and a plunger 26 which is to be inserted in the body 24 and is slidable upward and downward (or in the vertical direction) in the figure. At a position near to the center of the outer circumference of the body 24 in the vertical direction, there is formed a recess groove 24*a* in the form of a stripe (or band) which surrounds the outer circumference. At a position of the inner circumferential surface of the mounting hole 30 disposed opposite to the recess groove 24*a*, an oil gallery 32 to which the actuating oil is to be supplied is formed. The upper end portion of the plunger 28 carries an end of the rocker arm 17 which is disposed opposite to a portion thereof contacting the valve member 14, and functions as a supporting point for the swinging of the rocker arm 17. In the interior of the plunger 26, there is formed a reservoir 28 which communicates with the oil gallery 32 through the medium of a small hole 27*a* formed in a side wall and a small hole 24*b* formed in the body 24. In other words, the recess groove 24*a* in the form of a stripe, the small hold 24*b* and the small hole 27*a* constitute an actuating oil passage for introducing the actuating oil disposed in the oil gallery 32 into the reservoir 28. In addition, the reservoir 28 communicates with the plunger 26 through the medium of the high pressure chamber 29 and a small hole 27*b* to be formed between the plugner 26 and the bottom portion of the body, and is opened to the ambient air through the medium of a small hole 27*c* formed in the upper end portion of the plunger. In the Figure, a reference numeral 23 denotes a plunger spring, a reference numeral 25*a* denotes a check ball for blocking the small hole 27*b* by the urging force of a spring 25*b*, and a reference numeral 25*c* denotes a ball cage. When the internal pressure in the high pressure chamber 29 is increased, the check ball 25*a* blocks the small hole 27*b* and the plunger 26 is converted into a locked state so as to constitute a supporting point for the swinging of the rocker arm 17. A reference numeral 26*a* denotes an O-ring mounted to an outer circumference of the body. The O-ring 26*a* functions so as to retain a liquid sealing property between the body 24 and the mounting hole 30 and to prevent the actuating oil from leaking out through the clearance between the body 24 and the mounting hole 30 toward the upper portion of the mounting hole 30.

At the lower end portion of the outer circumference of the body 24, there is formed a tapered portion 24*c* for smoothly inserting the adjuster main body 22 into the mounting hole 30. On the outer circumference of the body 24, there is formed a helical groove 40 which extends from the position of the lower end tapered portion 24*c* to the position of the recess groove 24*a* in the form of a stripe (i.e., a position corresponding to the oil gallery 32). As a result, between the body 24 and the mounting hole 30, there is formed an air vent which extends from the lower end portion of the mounting hole 30 to the oil gallery 32, due to the helical groove 40 and the inner circumference of the mounting hole 30.

Figure 7:
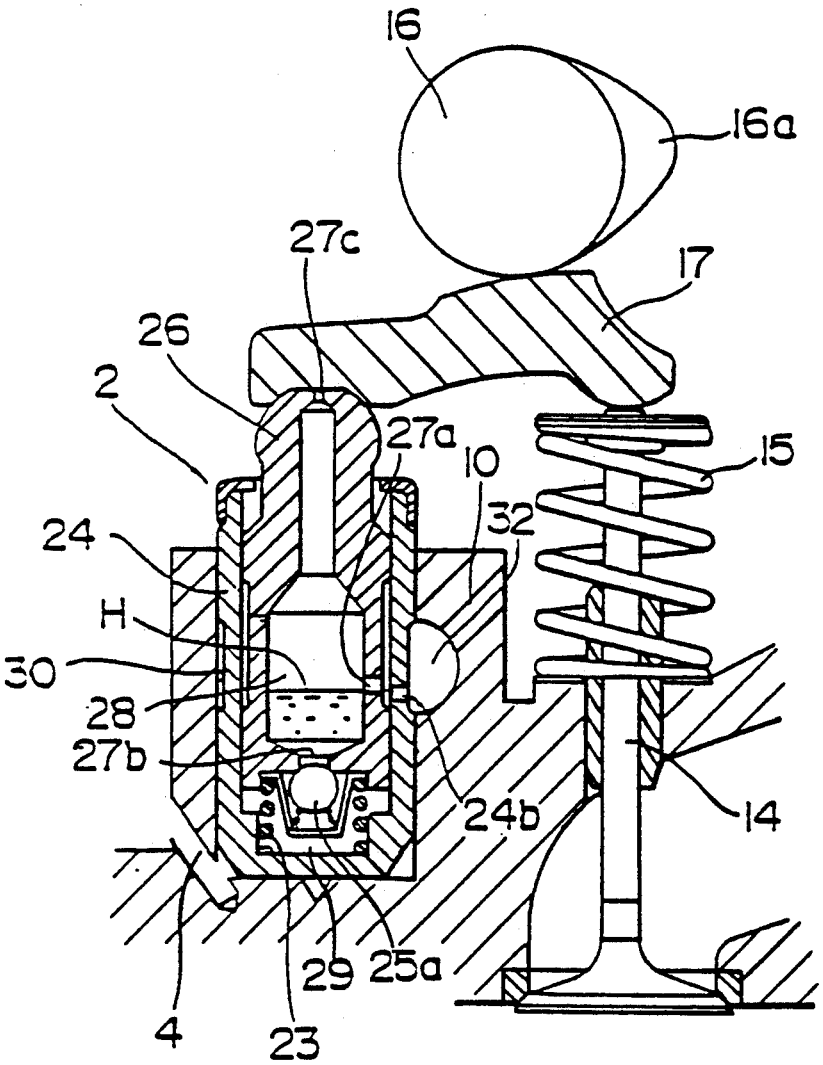
FIG. 7 PRIOR ART
FIG. 7 is a sectional view showing a periphery of a conventional oil pressure lash adjuster.

In the conventional structure, as shown by the reference numeral 4 in FIG. 7, the air vent is opened to the ambient air, and therefore there is posed a problem such that the actuating oil contained in the reservoir leaks out or overflow through the air vent. In the present embodiment, however, since the air vent is opened to the oil gallery 32, there is no possibility that the actuating oil contained in the reservoir 28 overflows at the time of the driving of the internal combustion engine, since the air vent is opened to the oil gallery 32 (or has an opening in the gallery 32). On the other hand, at the time of the stoppage of the internal combustion engine, the actuating oil contained in the reservoir 28 can slightly leaks out through the clearance between the body 24 and the plunger 26, or the clearance between the mounting hole 30 and the body 24. However, the amount of the oil leaking out in such a manner is much smaller than that in the case of the conventional structure, and the liquid level in the reservoir 28 is retained at a position denoted by a reference $H_1$ in FIG. 2.

When the adjuster main body 22 is intended to be mounted to the mounting hole 30, the adjuster main body 22 disposed above the mounting hole 30 is inserted into the mounting hole 30. At the time of the insertion of the adjuster main body 22, the air disposed in the mounting hole 30 is discharged to the oil gallery 32 through the air vent (or the helical groove 40) as described above. As a result, the adjuster main body 22 may smoothly be inserted into the mounting hole 30.

In addition, in the present embodiment, an air vent is not formed in the cylinder head 10 side which is difficult to be machined, but a groove is formed in the adjuster main body 22 side which is easy to be machined. As a result, the production cost may be reduced because the easy machining as described above.

In addition, in the prior art, it is necessary to ensure a space for the formation of an air vent in the cylinder head. In the present embodiment, however, since the air vent is formed in the adjuster main body 22 side, there is not posed a problem such that a space for the air vent is ensured in the cylinder head side.

Figure 3:
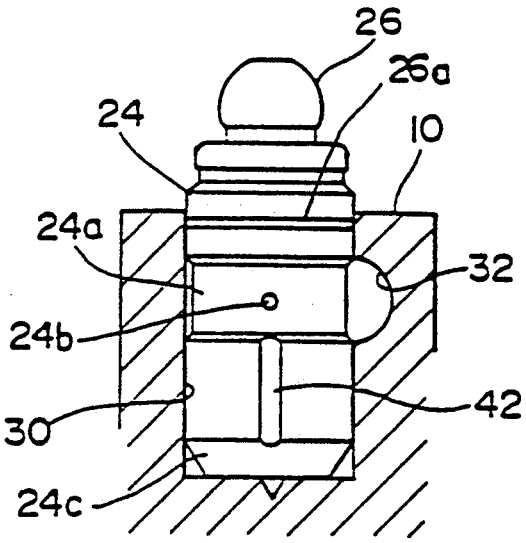
FIG. 3 is a sectional view showing a second embodiment of the present invention.

FIG. 3 is a sectional view showing a periphery of a lash adjuster equipped with an air vent according to a second embodiment of the present invention.

In the second embodiment, an air vent is constituted by use of a longitudinal (or vertical) groove 42 which extends in the shaft direction, in place of the helical groove 40 used in the first embodiment as described above.

Figure 4:
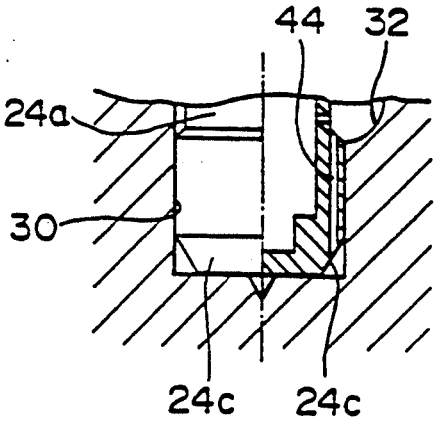
FIG. 4 is a sectional view showing a third embodiment of the present invention.

FIG. 4 is a sectional view showing an important part of an oil pressure lash adjuster equipped with an air vent according to a third embodiment of the present invention. In the present embodiment, there is formed a vertical through hole 44 which extends from a position disposed opposite to the recess groove 24*a* of the body 24 and the oil gallery 32 to the lower end tapered portion 24*c*. The through hole 44 constitutes an air vent.

Figure 5A:
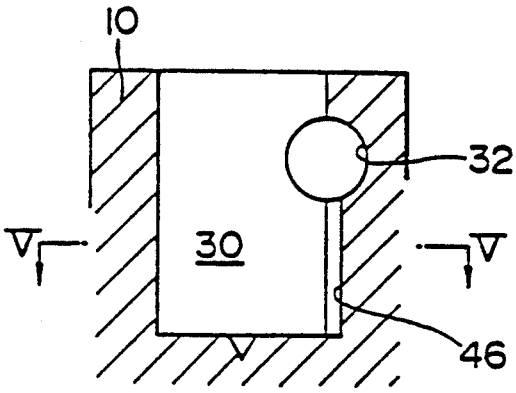
FIG. 5(*a*) is a sectional view showing a fourth embodiment of the present invention.
Figure 5B:
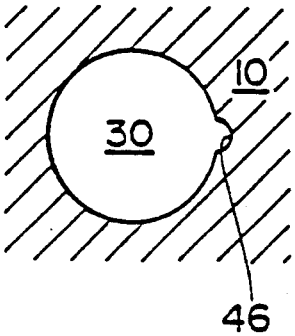

FIGS. 5(*a*) and 5(*b*) show a fourth embodiment of the present invention. FIG. 5(*a*) is a longitudinal sectional view showing a periphery of a lash adjuster mounting hole, and FIG. 5(*b*) is a cross sectional view taken along a line V—V shown in FIG. 5(*a*).

In the first to third embodiments as described above, the groove 40 (or 42), or the hole 44 is formed in the adjuster main body 22 side. In the fourth embodiment, however, a vertical (or longitudinal) groove 48 for constituting an air vent is formed on the inner circumference of the mounting hole 30.

Figure 6:
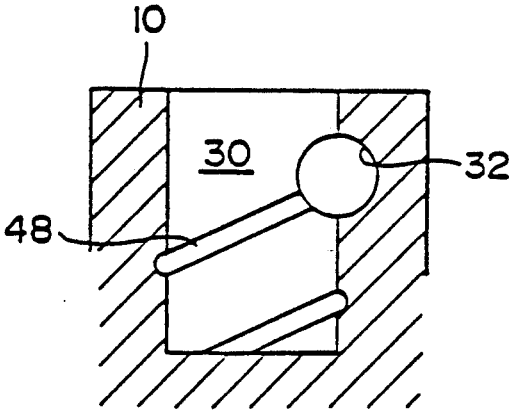
FIG. 6 is a sectional view showing a fifth embodiment of the present invention.

FIG. 6 shows a fifth embodiment of the present invention and is a longitudinal sectional view showing a periphery of a lash adjuster mounting hole.

In the fifth embodiment, a helical groove 48 for constituting an air vent is formed in the inner circumference of the mounting hole 30 so that it extends from the lower end portions of the mounting hole 30 to the oil gallery 32.

In the embodiments as described above, the tapered portion 24*c* is formed at the lower end portion of the body 24. However, it is also possible to omit the tapered portion 24*c*.

In the embodiments as described above, the groove 40, 42, 46 or 48 for constituting an air vent is formed in either one of the outer circumference of the body 24 and the inner circumference of the mounting hole 30. However, it is also possible to form a groove for constituting an air vent in both of the outer circumference of the body 24 and the inner circumference of the mounting hole 30.

As described hereinabove, in the case of the oil pressure lash adjuster equipped with an air vent according to the present invention, when the lash adjuster main body is intended to be inserted to the mounting hole, the air disposed in the mounting hole is discharged to the oil gallery through the air vent so that the adjuster main body may smoothly be mounted.

In addition, in the present invention, there is no possibility that the actuating oil contained in the reservoir overflows or leaks out, not only at the time of the driving of the internal combustion engine but also at the time of the stoppage thereof. As a result, the interior of the lash adjuster main body (or the interior of the reservoir) is always maintained in a state wherein the interior is filled with the actuating oil, and the lash adjuster is properly operated so as to rectify the space or clearance of the valve.

In addition, in the present invention, since the actuating oil is not consumed wastefully, the size of the oil pump to be used in combination with the lash adjuster may be reduced as compared with that in the prior art. As a result, the problems posed in the prior art may be solved.

It will be understood that each of the elements described above, or two or more together, may also find a useful application in other types of constructions differing from the types described above.

While the invention has been illustrated and described as embodied in an oil pressure lash adjuster equipped with air vent, it is not intended to be limited to the details shown, since various modifications and structural changes may be made without departing in any way from the spirit of the present invention.

Without further analysis, the foregoing will fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An internal combustion engine with oil pressure lash adjustable valve actuating mechanism, comprising a cylinder head having a lash adjuster mounting hole with an upper opening; an oil gallery formed on an inner circumference of said lash adjuster mounting hole for supplying an actuating oil; an oil pressure lash adjuster having a lash adjuster main body inserted in said lash adjuster mounting hole and a plunger located in said lash adjuster main body and lockable by the actuating oil supplied from said oil gallery; a high pressure chamber located at a lower portion of said main body to receive said actuating oil; a valve actuating member having a swingable rocker arm arranged so that said lash adjuster main body forms a supporting point for swinging of said rocker arm; and an air vent communicating a lower end portion of said lash adjuster mounting hole with said oil gallery, said air vent being provided at an outer circumference of said adjuster main body.

2. An internal combustion engine as defined in claim 1, wherein said adjuster main body has a recessed groove formed as a stripe and forming a passage for said actuating oil for locking said plunger in said adjuster main body, said recessed groove being located at a position of said adjuster main body which corresponds to said oil gallery so as to surround said adjuster main body.

3. An internal combustion engine as defined in claim 2, wherein said air vent being formed by a groove provided at said outer circumference of said adjuster main body below said recessed groove, said inner circumference of said lash adjuster mounting hole being in sliding contact with said outer circumference of said adjuster main body.

4. An internal combustion engine as defined in claim 1, wherein said adjuster main body has a tapered lower end portion so that a diameter of said tapered lower end portion decreases toward a lower end of said adjuster main body.

5. An internal combustion engine as defined in claim 3, wherein said groove which forms said air vent is a helical groove.

6. An internal combustion engine as defined in claim 3, wherein said groove which forms said air vent is a longitudinal groove.

7. An internal combustion engine with oil pressure lash adjustable valve actuating mechanism, comprising a cylinder head having a lash adjuster mounting hole with an upper opening; an oil gallery formed on an inner circumference of said lash adjuster mounting hole for supplying an actuating oil; an oil pressure lash adjuster having a lash adjuster main body inserted in said lash adjuster mounting hole and a plunger located in said lash adjuster main body and lockable by the actuating oil supplied from said oil gallery; a high pressure chamber located at a lower portion of said main body to receive said actuating oil; a valve actuating member having a swingable rocker arm arranged so that said lash adjuster main body forms a supporting point for swinging of said rocker arm; and an air vent communicating a lower end portion of said lash adjuster mounting hole with said oil gallery, said air vent is formed as a through hole provided in said adjuster main body below said recessed groove.

* * * * *